United States Patent [19]

Johnson et al.

[11] 4,165,290

[45] Aug. 21, 1979

[54] FABRIC CARE COMPOSITION CONTAINING STARCH AND QUATERNARY AMMONIUM COMPOUND

[75] Inventors: Samuel M. Johnson; Emelyn L. Hiland, both of Cincinnati, Ohio

[73] Assignee: The Procter & Gamble Company, Cincinnati, Ohio

[21] Appl. No.: 885,937

[22] Filed: Mar. 13, 1978

[51] Int. Cl.[2] ..... D06M 13/36

[52] U.S. Cl. ..... 252/8.8; 8/115.6; 428/289

[58] Field of Search ..... 252/8.8, 8.6; 8/115.6; 428/289

[56] References Cited

U.S. PATENT DOCUMENTS

| | | | |
|---|---|---|---|
| 2,702,755 | 2/1955 | Chaney | 106/213 |
| 2,826,506 | 3/1958 | Trusler | 252/8.6 UX |
| 3,861,870 | 1/1975 | Edwards et al. | 252/8.8 |
| 4,035,307 | 7/1977 | Fry et al. | 252/8.6 |

*Primary Examiner*—William E. Schulz

*Attorney, Agent, or Firm*—Edmund F. Gebhardt; Thomas H. O'Flaherty; Richard C. Witte

[57] ABSTRACT

Compositions and process for preparing stable aqueous liquid dispersions containing specific stabilized gelatinized vegetable starch and quaternary ammonium antistatic and/or softening agents. The compositions herein are employed as fabric care agents, particularly following exposure of fabrics to washing media containing water-insoluble solvents.

7 Claims, No Drawings

FABRIC CARE COMPOSITION CONTAINING STARCH AND QUATERNARY AMMONIUM COMPOUND

BACKGROUND OF THE INVENTION

This invention relates to compositions and processes for preparing liquid dispersions containing stabilized gelatinized vegetable starch and quaternary ammonium compounds. More particularly the invention relates to compositions having use for providing or restoring a desirable texture to fabrics following a washing process.

The copending commonly assigned patent application of Rodney M. Wise and Sharon J. Mitchell entitled DETERGENT COMPOSITIONS FOR EFFECTIVE OILY SOIL REMOVAL (U.S. Ser. No. 839,221, filed Oct. 3, 1977) discloses compositions and methods for removing oily soils from fabrics involving treatment with specific mixtures of water-insoluble solvents and solvent soluble emulsifiers in aqueous washing media followed by treatment with surface-active agents to remove retained solvent and emulsifier from the fabrics.

The present invention provides a fabric care composition comprising a stabilized gelatinized vegetable starch and a cationic (i.e., cation active) quaternary ammonium anti-static and/or softening agent. The composition is useful in fabric care applications requiring provision or restoration of fabric body without the negative harshness or stiffness often associated with a starch treatment. As hereinafter described aqueous liquid starch dispersions are gelatinized and stabilized by exposure of the gelatinized starch to an alkaline compound to provide a pH in the range of from about 10 to about 13. The compositions contain from about 0.25% to about 10% of a quaternary ammonium compound and have a pH in the range of about 4 to about 11.

STATE OF THE ART

Stabilization of liquid starch dispersions to prevent retrogradation of gelatinized starch is known. Retrogradation is a phenomena attributed to molecular reassociation of starch to polymeric forms previously broken down by heat or treatment by acids, enzymes or oxidation.

U.S. Pat. No. 2,014,794, (Bierly) discloses inhibition of the congealing of starch solutions by addition of low levels of fatty alcohol sulfates.

U.S. Pat. No. 2,702,755, (Chaney) discloses the preparation of stable cornstarch dispersions in water by adding sodium hydroxide to provide a pH of 10 to 12 and cooking such dispersions with agitation at 140° F. to 160° F. for 5 to 30 minutes followed by cooling and neutralization to pH 5.5 to 7. There is no disclosure of the incorporation of quaternary ammonium compounds or that the process provides for stable combinations of starch and quaternary ammonium antistatic and/or softening agents.

U.S. Pat. No. 3,130,081, (Evans) discloses preparation of amylose dispersions in water at a pH range at which amylose is normally insoluble. The process involves addition of 4% to 10% of a strong alkali to 5% to 20% dispersions of amylose in water at a temperature of 90° F. to 180° F. followed by neutralization to a pH of 2 to 9. The process is said to be applicable to starch products containing at least 50% amylose as contrasted with natural vegetable starches that generally contain no more than about 30% amylose.

While the stabilization of vegetable starch and amylose by treatment with alkaline materials is known, it has not been recognized that such treatment provides a particular stability benefit to the combination of starch and cationic quaternary ammonium compounds in an aqueous medium.

The combination of textile sizing agents and fabric softeners has been suggested, generally for use in textile mills or in so called textile conversion applications. It has not been disclosed to combine a stabilized gelatinized vegetable starch and an effective level of a quaternary ammonium compound to provide a fabric care composition that provides body to fabrics without stiffness or harshness.

It is an object of the present invention to provide compositions of and processes for making stable aqueous dispersions containing gelatinized vegetable starch and cationic quaternary ammonium antistatic and/or softening agents.

A further object of this invention is to provide fabric care compositions adapted for use on fabrics previously exposed to washing media containing water-insoluble solvents.

These and other objects are obtained herein, as will be seen by the following disclosure.

SUMMARY OF THE INVENTION

The present invention encompasses an aqueous liquid fabric care composition suitable for restoring body to fabrics comprising: (a) from about 1% to about 25%, preferably from about 2.5% to about 10%, most preferably from about 3% to about 7%, by weight of a gelatinized and stabilized vegetable starch prepared by exposing an aqueous dispersion of gelatinized starch to a pH of from about 10 to about 13 and thereafter neutralizing excess alkali to result in a pH of from about 4 to about 9; (b) from about ¼% to about 10%, preferably from about ½% to about 3%, by weight of a cationic quaternary ammonium antistatic and/or softening agent; (c) from about 25% to about 98% water, said composition having a pH of from about 4 to about 11.

Vegetable starches suitable for use in the practice of this invention include cornstarch, wheatstarch, rice starch, and potato starch and modified starches. Cornstarch is particularly suitable.

Alkaline materials suitable for providing a pH of from about 10 to about 13 in the process of this invention include alkali metal hydroxides, carbonates, silicates, and phosphates.

The quaternary ammonium antistatic and/or softening agents of this invention are cationic quaternary ammonium salts in which four organic groups are bonded to nitrogen and the positive charge of this ion is balanced by a negative ion.

DETAILED DESCRIPTION OF THE INVENTION

The fabric care compositions of this invention comprise three essential ingredients: (1) a stabilized gelatinized vegetable starch; (2) a cationic quaternary ammonium anti-static and/or softening agent and (3) water.

The Starch

Starch derived from plant sources is generally a mixture of 15% to 40% linear chain amylose and 60% to 85% branched chain amylopectin. In raw form, plant derived starch is in minute water-insoluble granules that range in size from about 4 to 8 microns for rice to 15 to 100 microns for potato. Corn starch granules are generally in a 10 to 25 micron range. When water suspensions of vegetable starch granules are heated to progressively higher temperatures, nothing substantial occurs until a critical gelatinization temperature is reached, specific to the species of starch. At this temperature the granules swell, lose polarization crosses, and irreversibly lose anisotropy. Potato starch gelatinizes in the range of 56°–67° C., corn starch in the range of 62°–72° C., and rice and sorghum in the range of 68°–78° C. After initial gelatinization, the starch granules continue to swell and the granules' structure is at least partially disrupted to produce the thick-bodied consistency of a cooked starch paste.

Gelatinized starch dispersions are subject to stability problems of which retrogradation is particularly serious. In relatively concentrated dispersions, retrogradation results in a viscosity increase or gelling. In relatively dilute dispersions retrogradation can result in sedimentation. Retrogradation is attributed to molecular reassociation of amylose but dispersion viscosity is also a function of the extent of fragmentation of the swollen starch granules. Gelatinized but intact starch granules substantially contribute to dispersion viscosity.

The starch is preferably used at a level of from about 2.5% to about 10%, most preferably from about 3% to about 7%, by weight of the compositions.

The vegetable starches used in this invention include the so-called modified starches exemplified by starches treated with acid, enzymes or by oxidation or by addition of ether or ester groups. Modified starches generally provide relatively lower viscosity dispersions and are known as "thin boiling" starches. Pre-gelatinized modified starches can also be utilized, in which event no additional heating step is necessary.

Although treatment of aqueous starch compositions with alkaline materials is known, it has not previously been recognized that the resultant aqueous dispersion is particularly stable in the presence of cationic quaternary ammonium compounds and, optionally, in the presence of relatively large amounts of surface-active detergents and electrolytes in aqueous compositions.

The process of this invention provides for stabilization of aqueous starch dispersions by exposing an aqueous dispersion of a gelatinized starch to a pH of from about 10 to about 13, preferably from about 11 to about 12, and thereafter neutralizing any excess alkali to provide a pH of from about 4 to about 9. If the starch has not previously been gelatinized, the starch should be held at a temperature above its gelatinization point for at least about 5 minutes prior to, or simultaneously with the exposure to said pH.

While not wishing to be bound by theory, it appears that alkalinity increases the swelling power of the starch at temperatures above the gelatinization point and that this result in an increase in granule breakdown with a resultant decrease in viscosity. The general mechanism of improved phase stability of alkaline treated gelatinized starch in the presence of surface active agents is believed to involve a reduction of the molecular weight of the amylose fraction and an improved resistance of the amylose to retrogradation, i.e., repolymerization.

Quaternary Ammonium Antistatic and/or Softening Agent

The quaternary ammonium antistatic and/or softening agent utilized in this invention are characterized by compounds containing one or more quaternary nitrogen groups in which four organic groups are bonded to the nitrogen. A particularly suitable class of compounds has the structure

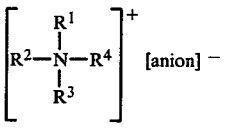

in which $R^1$, $R^2$, $R^3$, and $R^4$ are all hydrocarbon radicals or substituted hydrocarbon radicals and at least one contains 10 or more carbon atoms. Examples of suitable compounds are ditallowalkyl dimethyl ammonium chloride, dicocoalkyl dimethyl ammonium methyl sulfate, stearyl trimethyl ammonium chloride and dodecyltrimethyl ammonium methyl sulfate. Also suitable are imidazolinium compounds containing a quaternary nitrogen such as methyl, 1-stearylamidoethyl, 2-stearyl imidazolinium methosulfate.

Water

The liquid fabric care compositions of this invention comprise from about 25% to about 98%, preferably from about 60% to about 95%, by weight of water.

Optional Ingredients

Ingredients not inconsistent with the stability or performance of the fabric care compositions of the invention can be incorporated.

Electrolytes

Up to about 20% of an electrolyte can be incorporated in the compositions of this invention to improve phase stability. The presence of an electrolyte tends to reduce viscosity and protects the compositions from damage due to freezing. The electrolytes can be any suitable inorganic or organic ionizable compound such as salts or acids, e.g., alkali metal or alkaline earth metal chlorides, sulfates, carbonates, silicates, phosphates, acetates and citrates. Sodium and potassium carbonate are particularly preferred electrolytes.

Surface Active Agents

Surface active agents in addition to the cationic quaternary ammonium compounds can be incorporated in compositions of the invention. As discussed hereinbefore, the compositions of this invention can be employed in connection with the washing process disclosed in the co-pending, commonly-assigned patent application of Wise and Mitchell (U.S. Ser. No. 838,788). In this context the fabric care composition preferably contain from about 5% to about 50% of a surface active agent selected from the group consisting of anionic, nonionic, zwitterionic and amphoteric surface active agents and mixtures thereof. The surface active agent or mixture of surface active agents should have an HLB value of from about 11 to about 18 for optimum effectiveness. Suitable surface-active agents are disclosed in the copenindg application of Samuel M.

Johnson, Ser. No. 885,925, filed concurrently herewith, and incorporated herein by reference.

The quaternary ammonium compounds in the compositions of this invention act as fabric softening agents and antistatic agents and beneficially modify the fabric sizing effect of the starch. Also useful to provide improved fabric characteristics is the incorporation of smectite clays such as described in U. S. Pat. No. 3,936,537 incorporated herein by reference. Smectite clays can be used in the compositions of this inventions at levels up to about 15%, preferably from about ½% to about 8%. Suitable clays and compositions are disclosed in the copending application of John W. Leikhim and Sharon J. Mitchell, Ser. No. 885,933, filed concurrently herewith, and incorporated herein by reference.

In the process aspect of this invention, the alkaline pH can be provided by addition of sodium hydroxide or other alkaline material to a starch dispersion or to a mixture of the starch or other essential optional components of the fabric care composition. Any excess caustic is then neutralized with a mineral acid or other acidic material to obtain the requisite composition pH. The time required at the higher pH to provide stabilization will vary depending upon concentration, temperature, and agitation with a time on the order of about one to about five minutes being convenient. In a preferred embodiment, starch is simultaneously gelatinized and stabilized by holding a dispersion of natural starch at a temperature above the gelatinization point of the starch for at least 5 minutes at a pH of from about 10 to about 13.

In the method of use aspect of the present invention the fabric care composition is added to an aqueous laundry washing or rinse medium to provide from about 50 parts per million to about 500 ppm, specifically from about 150 ppm to about 350 ppm, most preferably from about 200 ppm to about 300 ppm of starch on a solids basis and from about 10 ppm to about 100 ppm, preferably from about 20 ppm to about 80 ppm, most preferably from about 30 ppm to about 50 ppm, of a cationic quaternary ammonium antistatic and/or softening agent.

Other ingredients can be included in minor amounts including; optical brighteners, perfumes, anti-redeposition agents, detergency builders, suds suppressors, soil release agents, dyes, opacifiers, pigments, anti-bacterial agents, suds boosters, corrosion inhibitors, etc.

In the following examples, the starch was stabilized, and gelatinized if necessary, before addition of other essential and optional components. Alternately all or part of other composition components may be present during the gelatinization and stabilization processes.

All percentages, parts, and ratios herein are by weight unless otherwise specified.

EXAMPLE I

| | |
|---|---|
| 3.8% | Starch (Corn Products 3401)<br>A water slurry was prepared under high shear. Temperature was raised to 170° F. and maintained for 10 minutes. The slurry is exposed to 0.05% NaOH under agitation for 2 minutes and excess alkali is then neutralized with HCl. To the resulting dispersion is added: |
| 0.07% | NaCl (from stabilization process) |
| 0.53% | Ditallowdimethylammonium chloride (DTDMAC) |
| 18.5% | Sodium neutralized $C_{13}$ linear alkyl benzene sulfonate |
| 8.0% | $Na_2CO_3$ |

-continued

| | |
|---|---|
| Balance | $H_2O$ |

EXAMPLE II

| | |
|---|---|
| 4.5% | Starch (Corn Products 3005)<br>Prepared by slurrying starch, then adding 0.5% KOH, applying sufficient heat to raise and maintain a temperature of 175° F. for 5 minutes, at which time excess alkali is neutralized by addition of an appropriate amount of $H_2SO_4$.<br>The following components are added: |
| 1.00% | Dicoconut alkyl dimethyl ammonium methyl sulfate. |
| 2.0% | Ethanol |
| 1.5% | $C_{12}$–$C_{13}$ linear alcohol, ethoxylated to an average of 6.5 EO groups. |
| 1.55% | $K_2SO_4$ (from starch stabilization process) |

EXAMPLE III

| | |
|---|---|
| 7.0% | Staramic 747 (A. E. Staley)<br>Pregelatinized starch prepared by slurrying under high shear and exposing to 2.0% $K_2CO_3$ for 2 minutes. Free alkali is neutralized by addition of $H_2SO_4$.<br>The following components are added: |
| 2.0% | $K_2CO_3$ |
| 1.5% | Stearyl trimethyl ammonium chloride |
| 2.5% | Ethanol |
| Balance | $H_2O$ |

EXAMPLE IV

| | |
|---|---|
| 5.0% | KOFILM 50 (Ester modified starch)<br>[National Starch and Chemical]<br>Prepared by slurrying under high shear, while raising and maintaining a temperature of 185° F. for 15 minutes. At this point, heat is removed and slurry is exposed under agitation to 1.5% NaOH for three minutes, after which excess alkali is neutralized with addition of an appropriate amount of HCl.<br>The following components are added: |
| 1.5% | Methyl, 1-stearylamidomethyl, 2-stearyl imidazolinium methosulfate. |
| 15.0% | Mg neutralized $C_{12}$ linear alkyl benzene sulfonate |
| 2.2% | NaCl (from starch stabilization process) |
| 2.0% | $C_{14}$–$C_{15}$ linear alcohol, ethoxylated to an average of 7 EO groupings. |
| 3.5% | Na toluene sulfonate |
| 2.0% | Ethanol |
| Balance | $H_2O$ |

What is claimed is:

1. A liquid fabric care composition suitable for restoring body and softness to fabrics comprising:
   (a) from about 1% to about 25% of a gelatinized and stabilized vegetable starch prepared by exposing a water dispersion of a gelatinized vegetable starch to a pH of from about 10 to about 13 to stabilize said starch and thereafter neutralizing any excess alkali to provide a pH of from about 4 to about 9;
   (b) from about 0.25% to about 10% of a cationic quaternary ammonium antistatic and/or fabric softening agent;
   (c) from about 25% to about 98% water.

2. The composition of claim 1 wherein the starch is gelatinized by holding a water dispersion of said starch at a temperature above its gelatinization temperature for at least about 5 minutes and stabilized by exposing said dispersion to a pH of from about 10 to about 13 during at least part of the gelatinization procedure.

3. The composition of claim 1 wherein the vegetable starch is corn starch.

4. The composition of claim 2 wherein the cationic quaternary ammonium antistatic and/or fabric softening agent is selected from the group consisting of:

(a) compounds having the structure

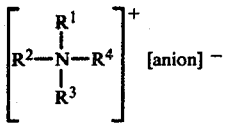

wherein $R_1$, $R_2$, $R_3$ and $R_4$ are hydrocarbon or substituted hydrocarbon radicals of which at least one contains 10 or more carbon atoms;

(b) alkyl imidazolinium compounds; and (c) mixtures thereof.

5. The composition of claim 4 wherein the cationic antistatic and/or fabric softening agent is ditallowalkyldimethyl ammonium chloride.

6. The composition of claims 1, 2, 3, 4 or 5 comprising from about 2.5% to about 10% by weight of gelatinized and stabilized vegetable starch.

7. The composition of claims 1, 2, 3, 4 or 5 comprising from about 2.5% to about 10% by weight of gelatinized and stabilized starch and from about 0.5% to about 3% by weight of cationic quaternary ammonium antistatic and/or fabric softening agent.

* * * * *